US005494094A

United States Patent [19]

Jacobsen

[11] Patent Number: 5,494,094

[45] Date of Patent: Feb. 27, 1996

[54] MOLD-PRESSING MACHINE WITH LIQUID-MIST INJECTION

[75] Inventor: Ole A. Jacobsen, Tisvildeleje, Denmark

[73] Assignee: Dansk Industri Syndikat A/S, Herlev, Denmark

[21] Appl. No.: 344,647

[22] Filed: Nov. 18, 1994

[30] Foreign Application Priority Data

Dec. 2, 1993 [DK] Denmark ..... 1351/93

[51] Int. Cl.[6] ..... B22C 15/00; B22C 19/00; B22C 23/02

[52] U.S. Cl. ..... 164/187; 164/149; 164/267

[58] Field of Search ..... 164/187, 149, 164/267, 37, 40

[56] References Cited

FOREIGN PATENT DOCUMENTS 285033 12/1990 Germany ..... 164/267
4228749 6/1993 Germany .
1452642 1/1989 U.S.S.R. ..... 164/267

*Primary Examiner*—J. Reed Batten, Jr.
*Attorney, Agent, or Firm*—Larson and Taylor

[57] ABSTRACT

In a mold-pressing machine with liquid-mist injection, using atomizing nozzles (9) with a vortex chamber (27) delivering atomized liquid mixed with air through outlet apertures (26), compressed air constantly being supplied to the atomizing-air nozzle (29), while the liquid nozzle (28) receives liquid under pressure through a liquid conduit (19,25), a liquid duct (31) and a slave valve (32,33) controlled by the liquid pressure solely in those periods, during which the liquid mist is desired to be injected, the new feature is that the liquid conduit (19,25) comprises a fast-acting air-escape valve (13), possibly of the same kind as those being used with pneumatic cylinders, causing any air having penetrated into the liquid duct (31) during the rest intervals because of a leak in the slave valve (32,33) to flow to an escape conduit (21). With this arrangement, the formation of air pockets in the liquid conduit is prevented: such air pockets would otherwise reduce the quantity of the liquid being supplied to the liquid nozzle (28) during each succeeding cycle.

6 Claims, 2 Drawing Sheets

MOLD-PRESSING MACHINE WITH LIQUID-MIST INJECTION

TECHNICAL FIELD

The present invention relates to a mold-pressing machine of the kind comprising:

a) a mold chamber bounded by at least one mold-chamber wall, b) filling means for filling particulate material into the mold chamber, c) pressing-force means adapted to move at least one mold-chamber wall towards at least; one other mold-chamber wall so as to compact particulate material therebetween, d) liquid-applying means adapted to introduce a liquid mist in the mold chamber prior to the latter being filled with particulate material by means of said filling means, said liquid applying means comprising at least one atomizing nozzle, in which liquid supplied under pressure is atomized by means of an air current, each atomizing nozzle comprising d1) a vortex chamber comprising at least one outlet aperture for a liquid-in-air dispersion and into which open d2) at least one first nozzle aperture adapted to supply the liquid, d3) at least one other nozzle aperture situated in the immediate vicinity of said first nozzle aperture and adapted to supply atomizing air, and d4) a stop valve adapted to close the passage to the first nozzle aperture and having a valve member spring-biased towards the closed position and capable of being moved away from the closed position by a piston being acted upon by pressure in the liquid conduit leading to the first nozzle aperture, e) air-supply means for supplying atomizing air under pressure to the other nozzle aperture or apertures, f) pressure-creating means for applying pressure to the conduit leading to the first nozzle aperture or apertures solely during the period during which the liquid mist is desired to be produced.

BACKGROUND ART

In mold-pressing machines of the kind referred to above, usually being adapted to operate automatically producing series of casting molds or casting-mold parts, it is of crucial importance that the correct quantity of liquid mist be injected in each cycle. Thus, an excess of liquid mist will, in addition to increasing the costs, create an unnecessary load on the environment, while too small quantities of liquid mist will result in an insufficient "lubrication" of the mold-chamber walls, in the worst case possibly causing the compacted object to stick to the mold-chamber walls, thus blocking the operation of the machine.

It is a relatively simple matter to ensure that the quantity of the injected liquid mist is held below a predetermined upper limit, this effect e.g. being attainable by means of a suitably time-controlled pump only applying pressure to the liquid to be atomized in a period corresponding to the desired quantity of liquid mist. Experience has shown, however, that it sometimes happens that the quantity of injected liquid mist is too small, and detailed investigations have shown that the cause is to be found in leaks—of shorter or longer duration—in the valve situated immediately upstream of the first nozzle aperture or the liquid-nozzle aperture in the atomizing nozzle concerned. Thus, such a leak will during the periods, in which the time-controlled pump mentioned does not apply pressure to the liquid-supply conduit, result in that the excess air pressure in the vortex chamber of the nozzle, due to the air pressure in the conduit concerned usually being maintained both before and after the periods in which there is a full pressure in the liquid-supply conduit, propagates backwards through the leaky valve to form an air pocket in the liquid-supply conduit. Then, when in the next cycle pressure is reapplied to the liquid-supply conduit for the spraying of a new portion of liquid mist, this air pocket will first have to be pressed out through the liquid-nozzle aperture, obviously shortening the interval during which the liquid is injected and hence reducing the quantity being injected.

SUMMARY OF THE INVENTION

On the background of the above discussion, it is the object of the invention to provide a mold-pressing machine of the kind referred to initially, with which it is possible not only to set an upper limit for the amount of liquid mist being injected into the mold chamber during each cycle, but also to set a reliable lower limit for this amount, and this object is achieved by means of a fast-reacting valve connected in the liquid conduit leading to each first nozzle aperture, said valve, when pressure in the part of the liquid conduit situated between said valve and the first nozzle aperture is higher than pressure on the liquid-supply side of the valve, connecting said part of the liquid conduit to an escape conduit and interrupting its connection to the liquid-supply side of the valve. With this arrangement, any air pockets unavoidably being formed when the valve of the nozzle is leaky will so to speak be sidetracked to a location, where they cannot influence the quantity of liquid supplied in each succeeding cycle.

The escape conduit constituting said "side track" may in principle be of any kind, but according to the invention it is preferred to provide a liquid reservoir with a liquid space for liquid to be supplied to the first nozzle aperture or apertures, and an air space situated above the liquid space, said escape conduit comprising a conduit leading to the air space. This contributes to avoiding liquid being wasted and the environment being influenced unfavourably.

It is preferred to provide a fast-reacting valve comprising:

a) a first connector connected to the liquid-supplying conduit, b) a second connector connected to the conduit part leading to the first nozzle opening; and c) a third connector connected to the escape conduit; and d) a valve chamber situated between the first and the third connector and having therein a slidingly supported valve member that, when pressure in the first connector is higher than in the second connector, permits flow from the first to the second connector but not to the third connector, and that, when pressure in the second connector is higher than in the first connector, permits flow from the second to the third connector but not to the first connector. This makes it possible to use valves that are commonly available on the market lander the designation "fast-acting air-release valve" or the like, originally intended for use with pneumatic working cylinders in order to increase the speed of their return stroke.

Further advantageous embodiments of the mold-pressing machine according to the invention, the effects of which—beyond what is self-evident—are explained in the succeeding detailed part of the present description.

BRIEF DESCRIPTION OF THE DRAWING

In the following detailed part of the present description, the invention will be explained in more detail with reference to the drawing, in which.

DETAILED DESCRIPTION OF THE PREFERRED EMBODIMENT

Figure 1:
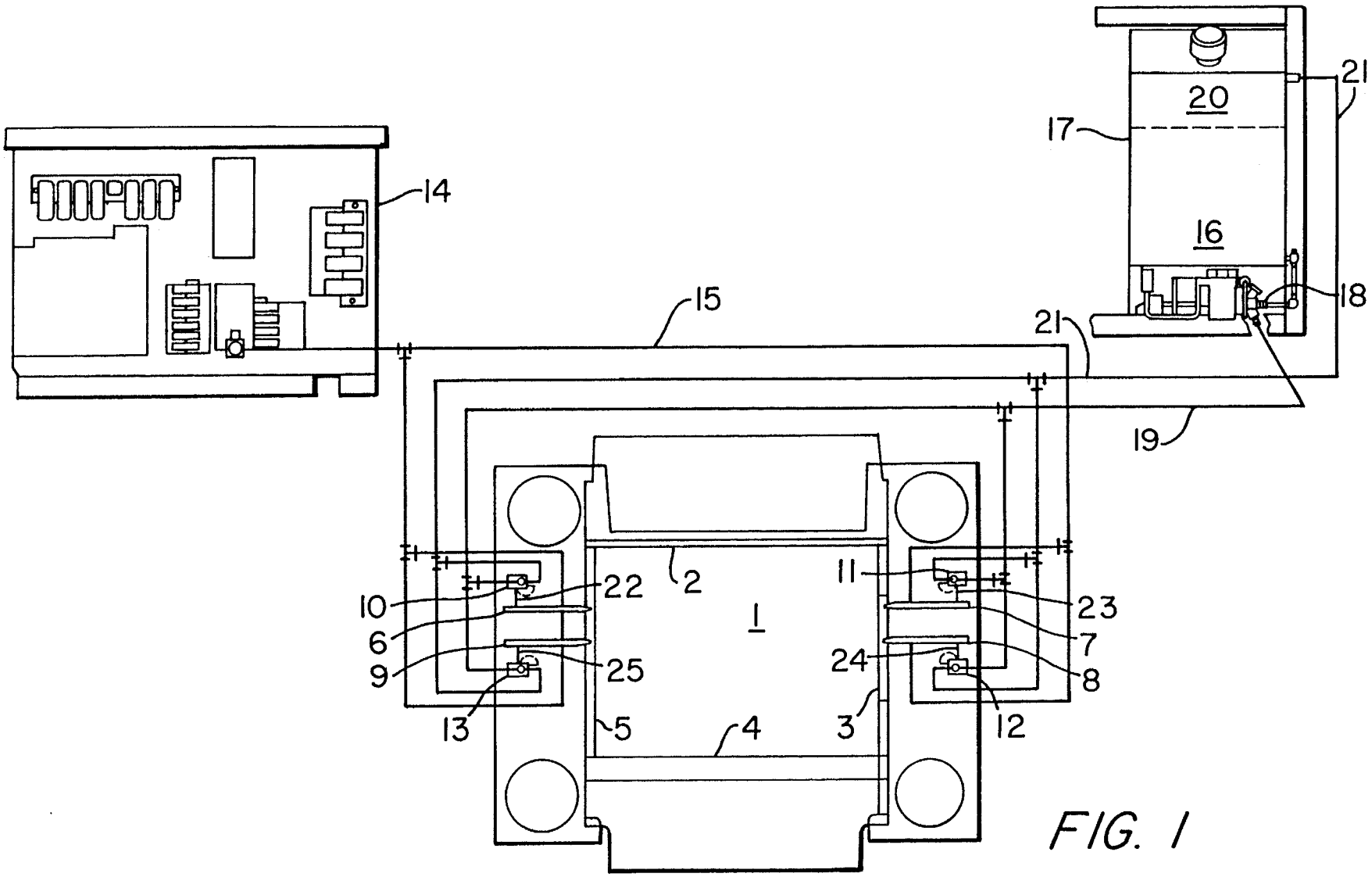
FIG. 1 is an overall view showing only those parts of the mold-pressing machine according to the invention with associated equipment necessary for the understanding of the invention, while FIG. 2 at a greatly enlarged scale shows one of the atomizing nozzles shown diagrammatically in FIG. 1, together with its associated air-escape valve.

The drawing shows solely those parts of a mold-pressing machine with associated auxiliary equipment necessary for the understanding of the invention. As persons skilled in this art will know, a mold-pressing machine of the kind here referred to requires for its operation various further means and mechanisms, the construction of which and co-operation of which with the components shown will be known to these persons.

Thus, FIG. 1 shows a mold chamber 1 bounded by four walls 2–5 visible in FIG. 1, as well as two further walls (not shown) situated in front of and behind the plane of the drawing, respectively. At least one of the walls of the mold chamber is adapted to be moved relative to the remaining walls in such a manner, that particulate material, e.g. mold sand, may be compacted in the mold chamber 1 about or against a pattern (not shown) so as in a manner known per se to form a casting mold or casting-mold part with a casting cavity.

To prevent the mold sand from adhering to the walls 2–5 and the two walls mentioned but not shown, a suitable liquid mixed with air is injected through a number of, in the example shown four, nozzles 6–9 of mutually identical construction, each associated with an air-escape valve 10–13, respectively, likewise of mutually identical construction. The nozzle 9 shown below to the left in FIG. 1, together with its associated air-escape valve 13, is shown in section and at a greatly enlarged scale in FIG. 2.

In the example shown and in operation, compressed air is constantly being supplied to the nozzles 6–9 from a compressed-air supply unit 14 through a branched compressed-air conduit 15. The liquid is supplied from the liquid space 16 in a liquid reservoir 17 through a time-controlled pump 18 and a branched liquid conduit 19. Any air being released by the air-escape valves 10–13 in a manner to be explained below is conducted to the air space 20 in the liquid reservoir 17 through an air conduit 21.

Each of the nozzles 6–9 is connected to an associated one of the air-escape valves 10–13through a short conduit 22–24, respectively.

The mode of operation of the nozzle 9 and the associated air-escape valve 13, being—of course—identical to the mode of operation of the remaining nozzles 6–8 with their associated air-escape valves 10–12, will now be explained in more detail with reference to FIG. 2.

The nozzle 9, adapted to deliver a mixture of atomized liquid and air through a number of outlet apertures 26 designed for the purpose, comprises in a manner known in principle a vortex chamber 27, into which open partly a centrally situated liquid-nozzle aperture 28, partly an annular air-nozzle aperture 29 situated coaxially about the aperture 28.

The air-nozzle aperture 29 is connected to the compressed-air conduit 15 through an air duct 30, and will thus be supplied with compressed air as long as the compressed-air supply unit 14 is operating, i.e. during the operation of the mold-pressing machine.

Figure 2:
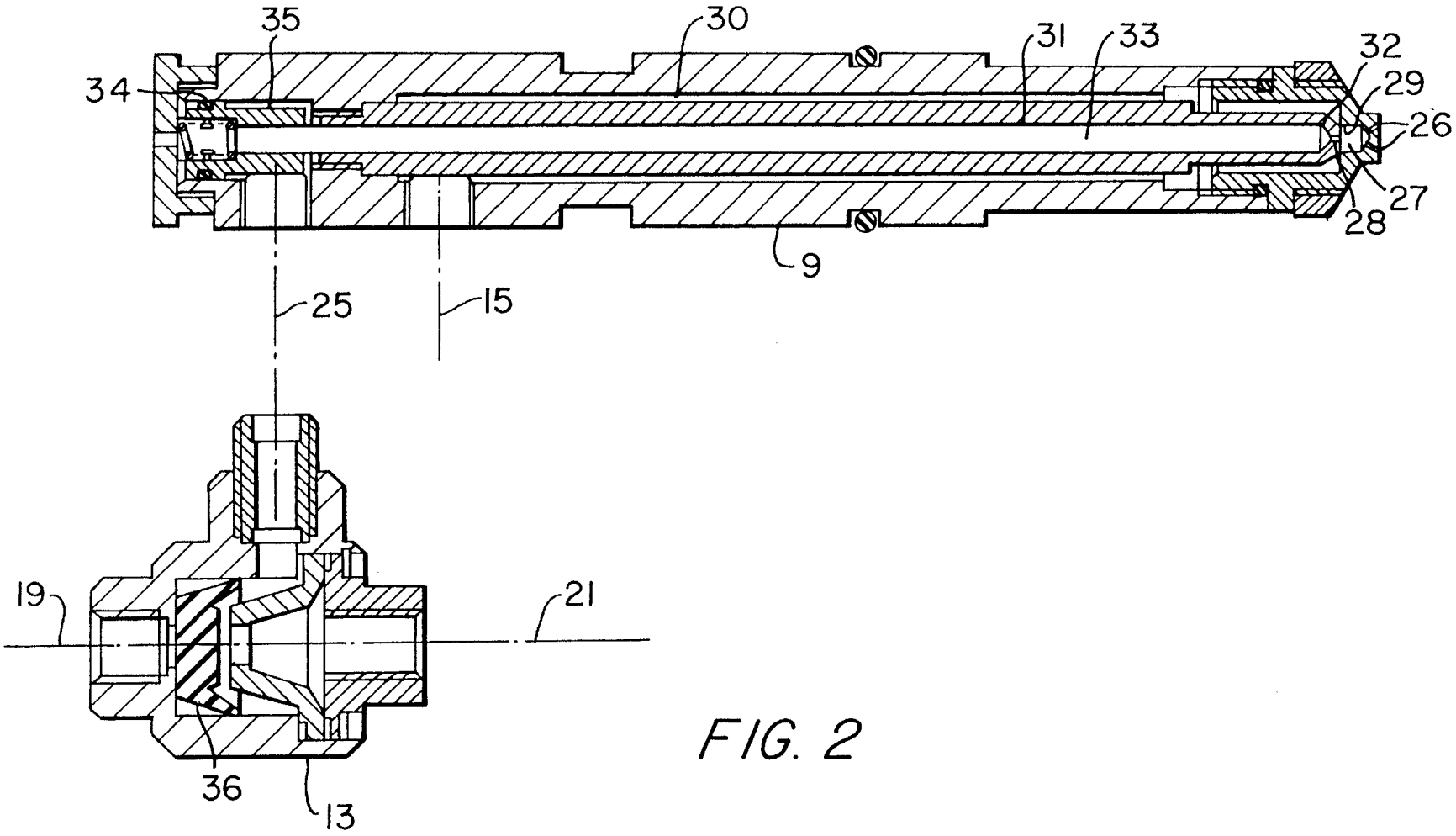

The centrally situated liquid-nozzle aperture 28 is connected to the short conduit 25 through a liquid duct 31 and with the liquid conduit 19 through the air-escape valve 13, but this connection also comprises a "slave valve" consisting of a valve seat 32 situated at the extreme downstream end of the liquid duct 31 and e.g. being constituted by an O-ring, as well as a valve member 33 in the form of a long rod slidably supported in the liquid duct 31 and carrying at its opposite end a piston 34 slidingly supported in a liquid-tight manner in a cylinder 35 in such a manner, that when liquid under pressure is supplied through the short conduit 25, the piston 34 will move to the left in FIG. 2, so that the "slave valve" 32,33 is opened, and the liquid flows out through the liquid duct 31 and the central liquid-nozzle aperture 28 to the vortex chamber 27, in which it is atomized by means of the air flowing into the vortex chamber 21 through the air-nozzle aperture 29, upon which it flows out through the outlet apertures 26 in the form of a finely atomized liquid mist.

By means of the time-controlled pump 18 and other control means (not shown) pressure is applied to the liquid conduit 19 solely during those periods, during which it is desired that a liquid mist be sprayed into the mold chamber 1. For reasons both economical and environmental it is important that no more liquid than strictly necessary be injected into the mold chamber 1, but—on the other hand—it is of crucial importance for the correct operation of the mold-pressing machine that a sufficient quantity of liquid be injected each time, as otherwise there would be a risk of the casting mold or casting-mold part having been pressed sticking to the walls of the mold chamber, causing the operation to be interrupted.

Experience has shown, that the "slave valve" 32,33 is not always completely liquid-tight in the closing position, even though its co-operating parts are made with extremely fine tolerances. As will appear from the above, the valve member 33 will be in the closing position shown in FIG. 2, when there is no pressure in the short conduit 25 because the time-controlled pump 18 does not apply pressure to the liquid conduit 19. Thus, this means that the pressure in the liquid duct 31 in the nozzle 9 is low, and if now there is a leak between the O-ring 32 and the valve member 33, air from the vortex chamber 27, permanently having pressure above atmospheric due to the connection to the compressed-air conduit 15, will be able to penetrate into the liquid duct 31 and form an air pocket in the latter, possibly also in the short conduit 25 and—what it is the object of the invention to prevent—into the liquid conduit 19. The pressure in the liquid conduit 19 is, however, low, in fact lower than the pressure in the short conduit 25 due to the flow of air to the latter, for which reason the valve member 36 in the air-escape valve 13 will take up the position shown in FIG. 2, in which it partly blocks the access to the liquid conduit 19, partly opens the outlet to the air conduit 21, so that the leakage air will flow through the air conduit 21 to the air space 20 uppermost in the liquid reservoir 17. As soon as the liquid conduit 19 is set under pressure in the next cycle, the valve member 36 in the valve 13 will be moved to its second position (not shown), in which it blocks the access to the air conduit 21, but—since it in a known manner consists of rubber or similar material and comprises a circumferential, elastically yielding sealing lip, that in the position mentioned but not shown functions as a non-return valve—opens the connection from the liquid conduit 19 to the short conduit 25 and hence to the nozzle 9.

If the leak in the "slave valve" 32,33 has disappeared the next time the pressure decreases in the liquid conduit 19 and hence in the short conduit 25—this could possibly be due to some foreign matter, that had caused the leak, having been blown out—the valve member 36 in the valve 13 will remain in its position mentioned but not shown, in which there is free communication between the liquid conduit 19 and the short conduit 25 to the nozzle 9.

It will be realized that when a leak of the kind referred to above occurs in the "slave valve" 32,33, the first fluid to flow into the air-escape valve 10 through the short conduit 25 will be liquid, while the next fluid to flow will, of course, be air flowing in from the vortex chamber 27. This will unavoidably cause a certain amount of liquid to flow out into the air conduit 21, but since the latter as shown in FIG. 1 opens into the air space 20 above the liquid space 16 in the liquid reservoir 17, this constitutes no problem, since the liquid components will only fall down into the liquid space 16 and join the liquid already present there.

When a leak has occurred in the "slave valve" 32,33 as described above, a small amount of air will unavoidably remain in the liquid duct 31 and the short conduit 25. For this reason these parts should be dimensioned in such a manner, that their volume is a minimum, so that the air pockets being formed to the least possible extent influence the magnitude of the quantity of liquid being injected in each cycle. This condition is partly met by the fact that the valve member 33 almost, but not completely, occupies the space in the liquid duct 31. In practice, the short conduit 25 is made even shorter than indicated in the drawing, since the air-escape valve may be secured directly to the nozzle by using standardized screw threads.

A more detailed description of the equipment not having been shown, that the mold-pressing machine according to the invention is to comprise or be associated with, such as filling means for filling particulate material in the mold chamber and pressing-force means for moving at least one mold-chamber wall towards at least one other mold-chamber wall in order to compact the particulate material, may be found in DK-patent application No. 2945/84 and U.S. Pat. No. 4,791,974, the content of which to the extent comprising such a description is to be considered as a part of the present description.

LIST OF PARTS

| | |
|---|---|
| 1 | mold chamber |
| 2 | wall |
| 3 | wall |
| 4 | wall |
| 5 | wall |
| 6 | nozzle |
| 7 | nozzle |
| 8 | nozzle |

-continued

LIST OF PARTS

| | | |
|---|---|---|
| 9 | nozzle | |
| 10 | air-escape valve | |
| 11 | air-escape valve | |
| 12 | air-escape valve | |
| 13 | air-escape valve | |
| 14 | compressed-air supply unit | |
| 15 | compressed-air conduit | |
| 16 | liquid space | |
| 17 | liquid reservoir | |
| 18 | controlled pump | |
| 19 | liquid conduit | |
| 20 | air space | |
| 21 | air conduit | |
| 22 | short conduit | |
| 23 | short conduit | |
| 24 | short conduit | |
| 25 | short conduit | |
| 26 | outlet aperture | |
| 27 | vortex chamber | |
| 28 | liquid-nozzle aperture | |
| 29 | air-nozzle aperture | |
| 30 | air duct | |
| 31 | liquid duct | |
| 32 | valve seat / O-ring | slave valve |
| 33 | valve member | slave valve |
| 34 | piston | |
| 35 | cylinder | |
| 36 | valve member | |

I claim:

1. Mold-pressing machine for producing casting molds or casting-mold parts by compacting particulate material, comprising:

a) a mold chamber bounded by at least one mold-chamber wall, b) filling means for filling particulate material into the mold chamber, c) pressing-force means adapted to move at least one mold-chamber wall towards at least one other mold-chamber wall so as to compact particulate material therebetween, d) liquid-applying means adapted to introduce a liquid mist in the mold chamber prior to the latter being filled with particulate material by means of said filling means, said liquid—applying means comprising at least one atomizing nozzle, in which liquid supplied under pressure is atomized by means of an air current, each atomizing nozzle comprising d1) a vortex chamber comprising at least one outlet aperture for a liquid-in-air dispersion and into which open d2) at least one first nozzle aperture adapted to supply the liquid, d3) at least one other nozzle aperture situated in the immediate vicinity of said first nozzle aperture and adapted to supply atomizing air, and d4) a stop valve adapted to close the passage to the first nozzle aperture and having a valve member spring-biased towards the closed position and capable of being moved away from the closed position by a piston being acted upon by pressure in the; liquid conduit leading to the first nozzle aperture, e) air-supply means for supplying atomizing air under pressure to the other nozzle aperture or apertures, f) pressure-creating means for applying pressure to the conduit leading to the first nozzle aperture or apertures solely during the period during which the liquid mist is desired to be produced, and g) a fast-reacting valve connected in the liquid conduit leading to each first nozzle aperture, said valve, when pressure in the part of the liquid conduit situated between said valve and the first nozzle aperture is higher than pressure on the liquid-supply side of the valve, connecting said part of the liquid conduit to an escape conduit and interrupting its connection to the liquid-supply side of the valve.

2. Machine according to claim 1 further comprising a liquid reservoir with a liquid space for liquid to be supplied to the first nozzle aperture or apertures, and an air space situated above the liquid space, said escape conduit comprising a conduit leading to the air space.

3. Machine according to claim 1, wherein said fast-reacting valve comprises a) a first connector connected to the liquid-supplying conduit, b) a second connector connected to the conduit part leading to the first nozzle opening, and c) a third connector connected to the escape conduit, and d) a valve chamber situated between the first and the third connector and having therein a slidingly supported valve member that, when pressure in the first connector is higher than in the second connector, permits flow from the first to the second connector but not to the third connector, and that, when pressure in the second connector is higher than in the first connector, permits flow from the second to the third connector but not to the first connector.

4. Machine according to claim 1, further comprising means for controlling pressure in the part of the liquid conduit upstream of the fast-reacting valve in such a manner, that said upstream pressure is made to be higher or lower than pressure in the part downstream of the valve.

5. Machine according to claim 1, further comprising means for controlling air pressure in the conduit leading to the other nozzle aperture or apertures in a programmed sequence with changes in liquid pressure in the part of the liquid conduit situated upstream of the fast-reacting valve and in a sequence with an operating cycle of the machine.

6. Machine according to claim 5, wherein said means for controlling the air pressure comprises means for utilizing air in the conduit leading to the other nozzle aperture or apertures for blowing foreign matter out of the vortex chamber and the outlet aperture when said stop valve is closed.

* * * * *